US006061028A

United States Patent [19]

Sakata

[11] Patent Number: 6,061,028

[45] Date of Patent: May 9, 2000

[54] PLANE ANTENNA SYSTEM FOR MOBILE COMMUNICATION EQUIPMENT

[75] Inventor: Yoshihiro Sakata, Tokyo, Japan

[73] Assignee: Musou Co., Ltd., Tokyo, Japan

[21] Appl. No.: 09/101,298

[22] PCT Filed: Sep. 26, 1997

[86] PCT No.: PCT/JP97/03437

§ 371 Date: Feb. 8, 1999

§ 102(e) Date: Feb. 8, 1999

[87] PCT Pub. No.: WO98/24142

PCT Pub. Date: Jun. 4, 1998

[30] Foreign Application Priority Data

Nov. 25, 1996 [JP] Japan ..... 8-012534

[51] Int. Cl.[7] ..... H01Q 1/24

[52] U.S. Cl. ..... 343/702; 343/718

[58] Field of Search ..... 343/702, 718, 343/700 MS, 741, 742, 866, 867, 795, 872; 455/89, 90

[56] References Cited

U.S. PATENT DOCUMENTS 5,420,599 5/1995 Erkocevic ..... 343/702

5,557,293 9/1996 McCoy et al. ..... 343/702

*Primary Examiner*—Hoanganh Le

*Assistant Examiner*—Tan Ho

*Attorney, Agent, or Firm*—Arent Fox Kintner Plotkin & Kahn, PLLC

[57] ABSTRACT

A flat antenna unit for a mobile communication equipment which is pasted on the mobile communication equipment so that it is touched by a human hand when in use, comprising a flexible insulated base; a receiving circuit which is formed on the flexible insulated base and which comprises three conductive layers of a pair of U-shaped conductive layers which are isolated and symmetrically disposed each other, a pair of conductive layers which have bent sections at the ends thereof and which are isolated and symmetrically disposed on the both sides of the U-shaped conductive layers, and a conductive layer which is isolated from the above-mentioned conductive layers as well as from the U-shaped conductive layers and which is located above the U-shaped conductive layer; and an insulator which is formed by potting insulating ink for example and which is coated on the receiving circuit. The flat antenna unit is characterized in that when the insulator is touched by the hand, a tuning capacitor is formed between the hand and the receiving circuit via the insulator. Thereby, the inventive antenna unit can eliminate troubles during speech like noise and interruption even when the radio efficiency is bad in using the mobile communication equipment such as a portable phone at places where the strength of electric field is weak.

2 Claims, 1 Drawing Sheet

PLANE ANTENNA SYSTEM FOR MOBILE COMMUNICATION EQUIPMENT

BACKGROUND OF THE INVENTION

1. Field of the Invention

The present invention relates to a flat antenna unit for a mobile communication equipment and more particularly to a technology which can enhance a communication sensitivity of a portable telephone by pasting the antenna unit on the back thereof.

2. Description of Related Art

When a mobile radio communication equipment such as a portable phone is used at places where the strength of electric field is low like a valley between tall buildings, within a building and within a vehicle, its radio efficiency drops, thus causing troubles in communication such as noise and speech interruption.

Then, in order to eliminate such troubles, there have been provided various antenna units including a so-called seal type flat antenna which is pasted on the back of a portable phone.

For instance, Japanese Utility Model Publication No. 3015919 has disclosed a flat antenna unit in which two antenna sect ions having symmetrical shapes and in which tuning capacitors are formed at both ends thereof are connected via a coupling circuit and both ends of the coupling circuit are connected by a feeder line. Further, Japanese Patent Laid-Open No. Hei. 5-259724 has disclosed a printed antenna similarly provided with feeding points and grounding sections.

Japanese Patent Laid-Open No. Hei. 6-140822 has disclosed a flat antenna unit in which a layer of a conductive material is provided on a supporting member and a receiving circuit is provided thereon as a receiving element of the flat antenna unit.

Still more, Japanese Patent Laid-open No. Hei. 4-14304 has disclosed a bi-directional loop antenna in which a conductor of a reactance element is added to each loop conductor so as to bring antenna impedance closer to terminal resistance.

By the way, the flat antenna unit must be miniaturized, lightened and thinned in order to paste on the back of the portable phone and is required that an occupied area of its antenna pattern is small, the rate of dielectric loss is low, the radio efficiency is high, the sensitivity is high, and the like.

From these points of view, the flat antenna unit disclosed in Japanese Utility Model Publication No. 3015919 has had a problem that the two symmetrical antenna sections in which the tuning capacitors are formed at the both ends must be connected by the coupling circuit and the impedance of the coupling circuit must be adjusted with the impedance of the antenna sections so that they are equalized. Similarly to that, the flat antenna unit disclosed in Japanese Patent Laid-Open No. Hei. 5-259724 has had a problem that it requires the feeding points and the grounding points, thus increasing the occupied area of the antenna pattern. The flat antenna unit disclosed in Japanese Patent Laid-Open No. Hei. 6-140822 has had problems that not only the layer of the conductive material must be provided on the supporting member but also the receiving circuit must be provided thereon in the receiving element of the flat antenna unit and that the process for forming the receiving circuit is complicated because it is formed by means of hot resist technology. The bi-directional loop antenna disclosed in Japanese Patent Laid-Open No. Hei. 4-14304 has had a similar problem that the process for forming the circuit is complicated because the occupied area of the relatively simplified antenna pattern is reduced by bringing the antenna impedance closer to the terminal resistance.

SUMMARY OF THE INVENTION

Accordingly, it is an object of the present invention to provide a technology which can eliminate the drawbacks of those prior art technologies.

According to the present invention, there is provided a flat antenna unit for a mobile communication equipment which is pasted on the mobile communication equipment so that it is touched by a human hand when in use, comprising a flexible insulated base; a receiving circuit which is formed on the surface of the flexible insulated base and which comprises three conductive layers of a pair of U-shaped conductive layers which are isolated and symmetrically disposed each other, a pair of conductive layers which have bent sections at the ends thereof and which are isolated and symmetrically disposed on the both sides of the U-shaped conductive layers, and a conductive layer which is isolated from the conductive layers as well as from the U-shaped conductive layers and which is located above the U-shaped conductive layer; and an insulator which is coated on the receiving circuit. It is characterized in that when the insulator is touched by the hand, a tuning capacitor is formed between the hand and the receiving circuit via the insulator.

The above and other objects and novel advantages of the invention will clearly appear from the following description and from the following drawings.

DESCRIPTION OF PREFERRED EMBODIMENTS

Figure 1A:
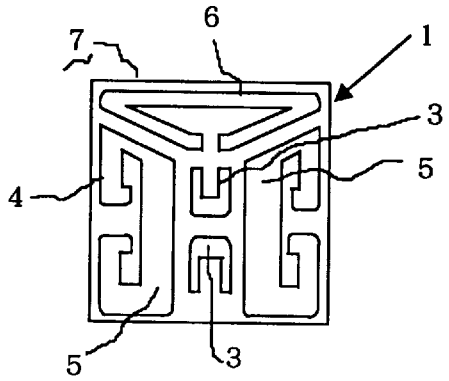
FIG. 1A is a plan view showing a flat antenna unit for a mobile communication equipment according an embodiment of the present invention.
Figure 1B:
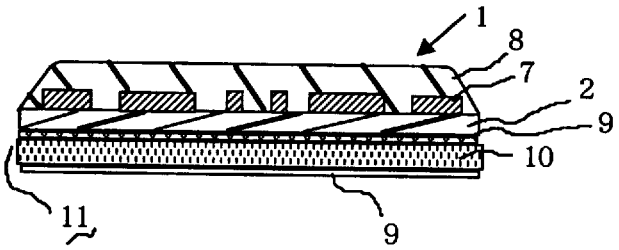
FIG. 1B is a section view showing a main part of the inventive unit according to the embodiment of the invention.

As shown in FIGS. 1A and 1B, a flat antenna unit 1 for a mobile communication equipment comprises, on the surface of a flexible insulated base 2, a receiving circuit 7 comprising three conductive layers of a pair of U-shaped conductive layers 3 which are isolated and symmetrically disposed each other, a pair of conductive layers (hereinafter referred to as bent conductive layers) 5 which have bent sections 4 at the ends thereof and which are isolated and symmetrically disposed on the both sides of the U-shaped conductive layers 3, and a conductive layer (hereinafter referred to as an upper conductive layer) 6 which is isolated from the bent conductive layers 5 as well as from the U-shaped conductive layers 3 and which is located above the U-shaped conductive layer 3. The receiving circuit 7 is coated by an insulator 8.

A pressure sensitive adhesive double coated sheet 11 in which an adhesive 9 is applied on the both sides of a sheet 10 is pasted on the back of the flexible insulated base 2 as shown in FIG. 1B. The adhesive double coated sheet 11 may be an adhesive tape as a matter of course. Further, a mount and the like on which the adhesive 9 is applied on the both sides thereof may be used instead of the adhesive double coated sheet 11.

Figure 1C:
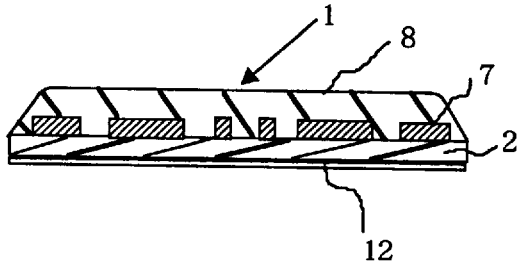
FIG. 1C is a section view showing the main part of the inventive unit before pasted on a portable phone according to another embodiment of the invention.

Further, an adhesive 12 may be applied on the back of the flexible insulated base 2 as shown in FIG. 1C.

The flexible insulated base 2 is made of a flexible resin film such as a polyester film, a polyethylene terephthalate film or the like.

The conductive layers 3, 5 and 6 composing the receiving circuit 7 may be formed by screen-printing conductive ink, paint or the like containing conductive fillers on the surface of the flexible insulated base 2.

Preferably, the insulator 8 coating the receiving circuit 7 is formed by printing or potting insulating ink. It may be also preferable to make the insulator 8 to be clear so that the receiving circuit 7 therein can be seen from the outside as shown in FIG. 1A.

Figure 1D:
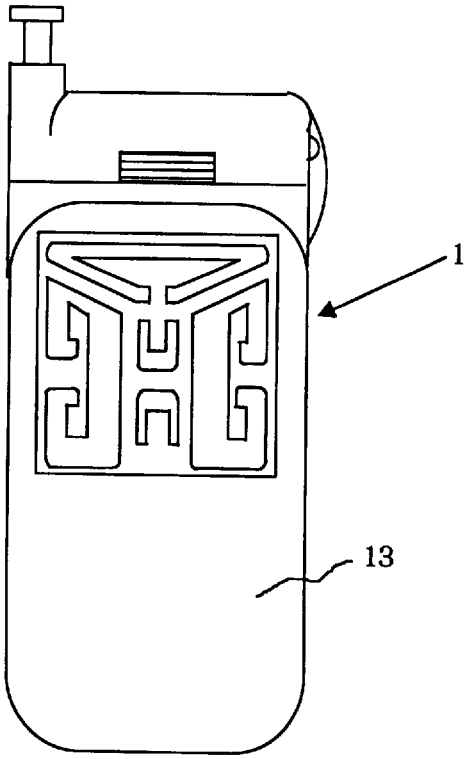
FIG. 1D is an explanatory drawing showing a mode of use after pasting the inventive unit on the portable phone.

In using such antenna unit 1, it is pasted on the back of the portable phone 13 via the adhesive double coated sheet 11 as shown in FIG. 1D in the mode having the adhesive double coated sheet 11 as shown in FIG. 1B. Or, the face of the adhesive 12 is pasted on the back of the portable phone 13 as shown in FIG. 1D in the mode having the adhesive 12 as shown in FIG. 1C.

The antenna unit 1 is pasted at the location where a human hand touches in pasting on the back of the portable phone 13. That is, it is pasted there so that when the insulator 8 is touched by the hand, a tuning capacitor is formed between the hand and the receiving circuit 7 via the insulator 8.

The receiving circuit 7 is composed of the patterns as described above and has a configuration convenient for forming the tuning capacitor between the receiving circuit 7 and the hand via the insulator 8. Further, the receiving circuit 7 receives radio waves caught by the human body, i.e. a good electrical conductor, as a large antenna and transmits it efficiently to the mobile communication equipment, thus enhancing the communication sensitivity of the mobile communication equipment in use.

As described above, the receiving circuit configured in the specific manner is formed on the flexible insulated base 2 and is coated by the insulator in the inventive flat antenna unit. Further, the inventive flat antenna unit is used by pasting at the part of the portable phone where the human hand touches. When the insulator is touched by the hand, the tuning capacitor is formed between the hand, the insulator and the receiving circuit as described above. That is, the inventive antenna unit is arranged so as to be able to eliminate the troubles during speech like noise and interruption caused by the low radio efficiency in using the portable phone at places where field strength is weak by reducing the noise during the speech or by compensating the weak field strength by catching and condensing the radio waves by the human body which is a good electrical conductor as a large antenna and by forming the tuning capacitor as described above.

The receiving circuit is composed of the circuit having the patterns of the specific configuration suited to such mode. That is, the three conductive layers in the receiving circuit have different occupied areas and shapes and form capacitors of specific capacitance, respectively, thus enhancing the efficiency of speech. Further, because the receiving circuit is formed on the flexible insulated base and is coated by the insulator or the insulator is formed by printing or potting the insulating ink as the other preferable embodiment of the inventive flat antenna unit, the flexible, small, light and thin flat antenna suitable for pasting on the back of the portable phone may be realized. Further, the inventive antenna unit requires no feeder line, coupling circuit or grounding circuit like the prior art units. It also requires to provide no receiving circuit on the layer of the conductive material nor to add a conductor of a reactance element to a loop conductor. Accordingly, the occupied area of the antenna pattern thereof is small, the rate of dielectric loss is low, the radio efficiency is high and the sensitivity is high, so that even when the radio efficiency drops in using the portable phone at places where the field strength is low like a valley between tall buildings, within a building and the like or in a state where fluctuation of intensity of the field strength is large like in a traveling vehicle and the like, the inventive antenna unit can prevent noise from entering or speech from being interrupted.

Industrial Applicability:

As described above, the inventive antenna unit can be applied usefully to a mobile communication equipment. That is, the present invention can achieve the flexibility, miniaturization, lightening and thinning which are required for the flat antenna to paste on the back of the portable phone. The inventive antenna unit also forms the tuning capacitor between the hand, the insulator and the receiving circuit when the insulator is touched by the hand, favorably receives the radio waves caught by the human body which is a good electrical conductor as a large antenna and transmits the radio waves to the mobile communication equipment efficiently, thus enhancing the communication sensitivity of the mobile communication equipment in use. Further, it requires no feeder line, coupling circuit or grounding circuit like the prior art units. It also requires to provide no receiving circuit on the layer of the conductive material nor to add a conductor of a reactance element to a loop conductor. Accordingly, the occupied area of the antenna pattern is small, the rate of dielectric loss is low, the radio efficiency is high and the sensitivity is high, so that even when the radio efficiency drops in using the portable phone at places where the field strength is low like a valley between tall buildings, within a building and the like or in a state where fluctuation of intensity of the field strength is large like in a traveling vehicle and the like, the inventive antenna unit can prevent noise from entering or speech from being interrupted.

While the preferred embodiments have been described, variations thereto will occur to those skilled in the art within the scope of the present inventive concepts which are delineated by the following claims.

What is claimed is:

1. A flat antenna unit for a mobile communication equipment which is pasted on the mobile communication equipment so that it is touched by a human hand when in use, comprising:

a flexible insulated base;

a receiving circuit which is formed on the surface of said flexible insulated base and which comprises three conductive layers of a pair of U-shaped conductive layers which are isolated and symmetrically disposed each other, a pair of conductive layers which have bent sections at the ends thereof and which are isolated and symmetrically disposed on the both sides of said U-shaped conductive layers, and a conductive layer which is isolated from said conductive layers as well as from said U-shaped conductive layers and which is located above said U-shaped conductive layer; and an insulator coated on said receiving circuit;

said flat antenna unit for a mobile communication equipment being characterized in that when a human hand touches said insulator, a tuning capacitor is formed between said hand and said receiving circuit via said insulator.

2. The flat antenna unit for a mobile communication equipment according to claim 1, wherein said insulator is formed by printing or potting insulating ink.

* * * * *